United States Patent [19]

Patin

[11] Patent Number: 4,484,857

[45] Date of Patent: Nov. 27, 1984

[54] BLADED TURBINE PUMP WITH ADJUSTABLE GUIDE VANES

[76] Inventor: Pierre Patin, 15 rue Buffon, 75005 Paris, France

[21] Appl. No.: 420,625

[22] Filed: Sep. 21, 1982

[51] Int. Cl.[3] ..... F01D 17/00

[52] U.S. Cl. ..... 415/146; 415/149 R

[58] Field of Search ..... 415/149 R, 149 A, 150, 415/146, 147

[56] References Cited

U.S. PATENT DOCUMENTS

| | | | |
|---|---|---|---|
| 2,645,410 | 7/1953 | Bauger et al. | 415/149 UX |
| 2,770,943 | 11/1956 | Beale | 415/149 UX |
| 3,050,036 | 8/1962 | Faisandier | 415/150 |
| 3,356,289 | 12/1967 | Plotkowiak | 415/149 R |
| 3,930,746 | 1/1976 | Kronogard | 415/149 R |
| 4,257,733 | 3/1981 | Bandukwalla et al. | 415/150 X |

*Primary Examiner*—Abraham Hershkovitz
*Assistant Examiner*—Joseph M. Pitko
*Attorney, Agent, or Firm*—Kerkam, Stowell, Kondracki & Clarke

[57] ABSTRACT

A turbine pump includes a rotor having blades disposed between blades of inlet and outlet guide vanes. The blades of the inlet and outlet guide vanes are mounted to swivel on spindles. Various control mechanisms are used to determine the rotation angle of the inlet blades relative to the rotation angle of the outlet blades. A simple control mechanism uses pinions and cranks to control the blade angle. More complicated versions of the control mechanism may use a camming arrangement or an electric motor. The turbine pump is especially advantageous for applications where the speed, flow, and pressure may vary greatly, for example hydraulic transmissions for vehicles.

8 Claims, 5 Drawing Figures

BLADED TURBINE PUMP WITH ADJUSTABLE GUIDE VANES

BACKGROUND OF THE INVENTION

This invention concerns an improvement in turbine pumps to insure that they will have a maximum output practically independent of their flow and their speed of rotation.

Turbine pumps have undergone multiple improvements in view of increasing their output, especially through the outline and finish of the rotor blades, as well as through bladed guide vanes located above or below the rotor, or both at the same time.

The optimal pitch of the guide vane blades, however, depends on the speed of rotation of the rotor and on the flow; hence the necessity for defining a nominal speed and a nominal flow for which the output would be maximum, and of accepting less output for the other possible values of speed and flow (or of the delivery pressure which is linked with the flow at given speed through the character of the pump).

SUMMARY OF THE INVENTION

To mitigate the effect of this drawback, this invention proposes automatic swivelling of the blades of the inlet guide vane so that the output will be maximum, whatever the rotation speed happens to be.

To this end, the turbine pump, according to the invention, comprises an inlet guide vane whose blades are adjustable, an outlet guide vane whose blades, likewise pivoting, take their orientation under the action of the fluid, and means for correlating the rotation angle of the inlet blades with the rotation angle of the outlet blades.

In an advantageous embodiment, the outlet blades are linked by connecting rod-crank assemblies to a first rim, the inlet blades to a second rim, and a control operates the rotation of said second rim in terms of the rotation of said first rim. Advantageously, the control is arranged so that the cotangent of the rotation angle of the inlet blades is a linear function of the cotangent of the rotation angle of the outlet blades. This control can be constructed by a shaft equipped with two pinions which respectively mesh with said first and second rims, or by a cam linking said first and second rims and having a profile that is specially adapted, or by a motor which drives said second ring and which is positioned by a logic circuit connected at its input to an angular position pick-up linked to said first rim.

BRIEF DESCRIPTION OF THE DRAWINGS

Other characteristics of this invention will appear upon reviewing the preferred embodient described below by way of illustration, and not by limitation, in view of the accompanying drawings in which:

FIGS. 1 and 2 include the classical elements of a turbine pump: the rotor 1 with its blades 2, the intake pipe 3 and the outlet casing 4.

Figure 1:
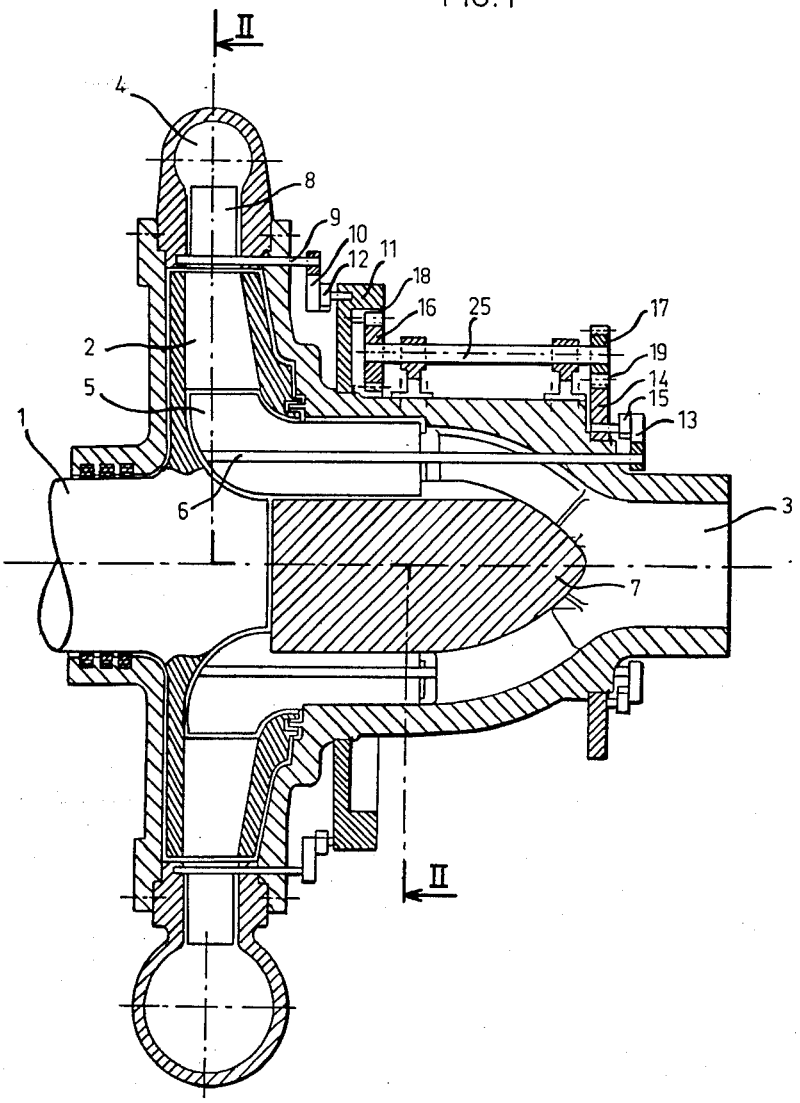
FIG. 1 is a longitudinal section of the turbine pump, on line I—I of FIG. 2.
Figure 2:
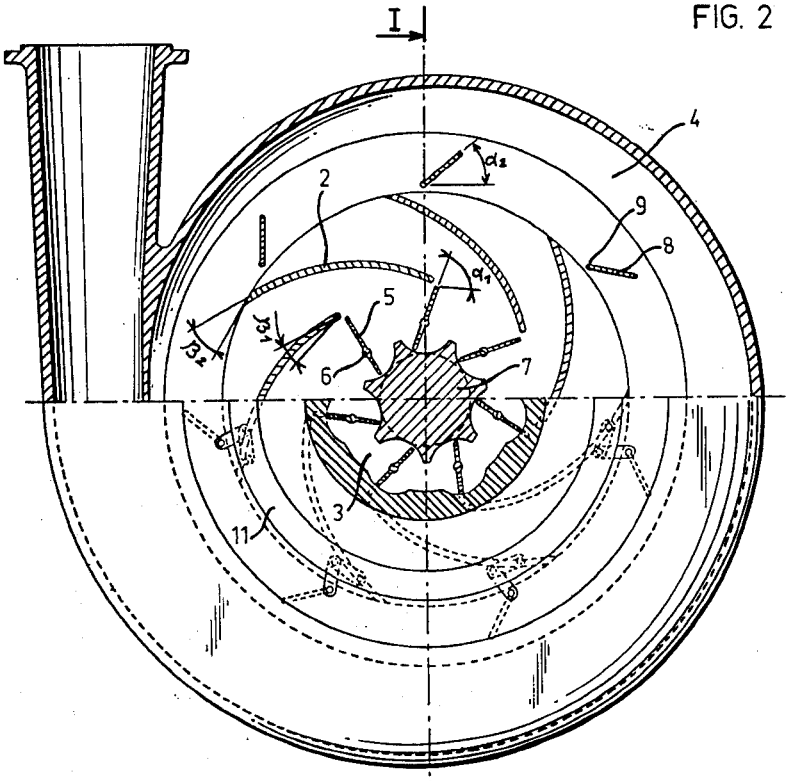
FIG. 2 is a transverse section, on line II—II of FIG. 1.

The inlet guide vane (or front guide vane) is composed of blades 5, seven in number in the drawing, which, unlike known constructions, are adjustable and not set. For that reason each of them comprises a spindle 6 approximately located in their middle area so that the pressures exercised by the fluids will become substantially balanced on either side of the blade. To insure the continuity of the fluid flow, a core 7 is located in the center of the intake pipe 3; its external profile and that of the pipe 3 form the path of the edges of the mobile blades 5.

It is known, through analysis of the triangle of inlet speeds, that a turbine pump will have a maximum output, if the fluid arrives on the rotor blades 2 with an angle $\alpha_1$, which depends on the inclination angle $\beta_1$ of the blades 2 of the rotor 1, on the speed of rotation $\Omega$ of the rotor, on the flow Q, on the radius $r_1$, and on the width $e_1$ of the cylindrical surface at the rotor inlet, according to the relationship:

$$\text{cotg}\,\alpha_1 = \frac{2\pi\Omega}{Q}\, r_1^2 \cdot e_1 - \text{cotg}\,\beta_1 \qquad (1)$$

Thus it can be seen that for these given dimensional characteristics $r_1$, $e_1$ and $\beta_1$, the optimal angle $\alpha_1$ depends on the speed of rotation $\Omega$ and on the flow Q.

As a consequence, in known constructions in which the angle $\alpha_1$ is constant, the turbine pump output is not maximum for a given value of the rotation speed $\Omega$, except for a certain flow Q.

For any other value this output decreases, which leads builders to establish networks of characteristic curves, giving the evolution of the output in terms of the speed, the flow and/or the lift pressure (output "peaks").

This phenomenon, scarcely noticeable when the height of the lift is constant, is much more bothersome when it is strongly variable, which is the case, for example, in hydraulic transmissions for vehicles.

So that this output will remain maximum, whatever the speed $\Omega$ and the flow Q may be, giving the angle $\alpha_1$ its correct value is all that is required, that is, the value derived from the above formula (1).

This certainly would be possible for measuring the flow Q and the speed $\Omega$, but is not easy; so the turbine pump, according to this invention, is based on another principle.

As a matter of fact, a law identical to the one mentioned above for the angle $\alpha_1$ exists between the values of the same parameters, this time taken at the level of the cylindrical surface at the outlet of the rotor and affected by rating 2; hence the relationship:

$$\text{cotg}\,\alpha_2 = \frac{2\pi\Omega}{Q}\, r_2^2 \cdot e_2 - \text{cotg}\,\beta_2 \qquad (2)$$

The result is, combining the two relationships (1) and (2), a relationship between angle $\alpha_1$, which the inlet guide vane must assume to offer maximum output, the angle $\alpha_2$, which the fluid flows assume upon coming out of the rotor. This relationship can be written:

$$\text{cotg}\,\alpha_1 = K \cdot \text{cotg}\,\alpha_2 + K' \qquad (3)$$

-continued $$\text{with } K' = \frac{r_1^2}{R_2} \cdot \frac{e_1}{e_2}$$

$$\text{and } k' = K \operatorname{cotg} \beta_2 - \operatorname{cotg} \beta_1$$

which shows clearly that angles $\alpha_1$ and $\alpha_2$ evolve according to a linear law of their cotangents whose terms are defined by the geometric characteristics of the turbine pump: $r_1$, $r_2$, $e_1$, $e_2$, $\beta_1$ and $\beta_2$, whatever the values of the flow Q and the speed $\Omega$ may be.

Thus the turbine pump, according to the invention comprises, in addition to the inlet guide vane with adjustable blades 5, an outlet guide vane (or rear guide vane) whose blades 8 are mounted to pivot around a spindle 9 located near the edge of the blade nearest to the rotor 1. This outlet guide vane receives the fluid upon its emergence from blades 2 of the rotor 1 and up to the time when it reaches the outlet casing 4. Its blades 8 are thus subjected to the outlet pressure of the fluid which therefore tends to make them assume an instantaneous inclination equal to the aforementioned angle $\alpha_2$ corresponding to the instantaneous values of the flow Q and the speed $\Omega$. Whenever at least one of these values varies, angle $\alpha_2$ varies in conformity with relationship (2).

The object being to obtain the proper inclination $\alpha_1$ of the inlet blades 5, a control linking the spindles 9 and 6 respectively of the outlet blades 8 and inlet blades 5 subjects the two sets of blades to a rotation caused by the rotation of the two spindles. The parameters determining this control are such that the constant relationship between the cotangents of angles $\alpha_1$ and $\alpha_2$ may be verified.

Figure 3:
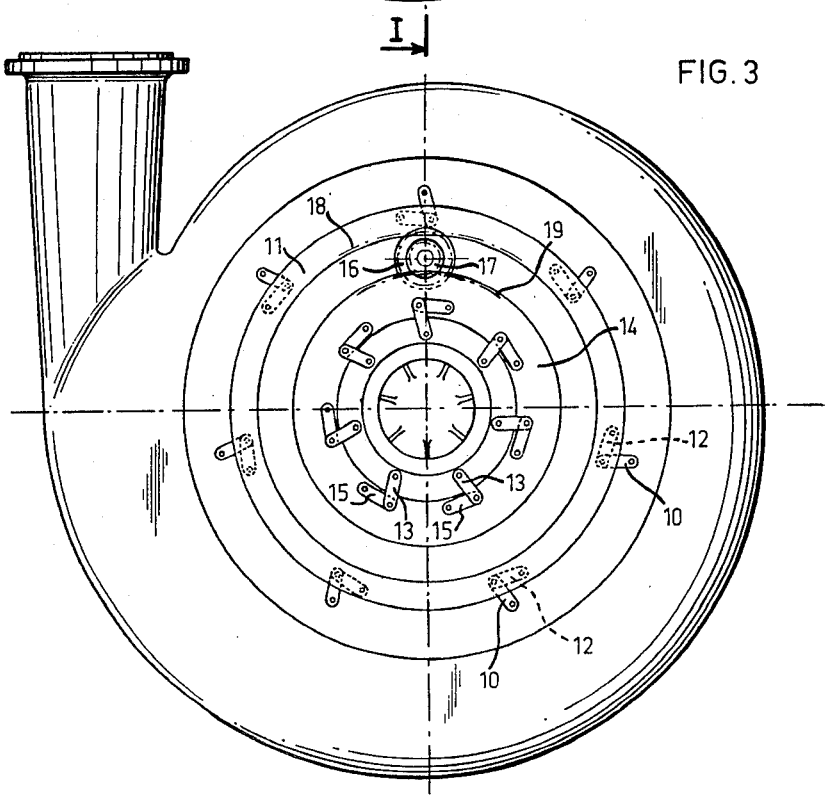
FIG. 3 is an external view showing, with FIG. 1, the control of the rotation of the blades.

This control may be constructed in various ways and particularly as shown in FIG. 3. Spindle 9 of each outlet blade 8 is supplied with a crank 10 which is connected with a rim 11 by a small rod 12. Given that the cranks 10 on the one hand and the small rods 12 on the other respectively have equal lengths, any rotation of the outlet blades 8 is matched by a rotation of the rim 11.

A similar assembly is associated with the inlet blades 5; it comprises cranks 13 secured to the spindles 6 and the small rods 15 which link these with a rim 14.

Whenever the range of variation of the speed and/or the flow is low enough, a linkage of the two rims 11 and 14 by a shaft 25 equipped with two pinions 16 and 17 which mesh with teeth 18 and 19 on the rims 11 and 12 makes it possible to obtain satisfactorily the relationship (3) between the angles $\alpha_1$ and $\alpha_2$ of the blades.

In other embodiments, a better approach to the relationship (3) will be possible through any angular means of control.

Figure 4:
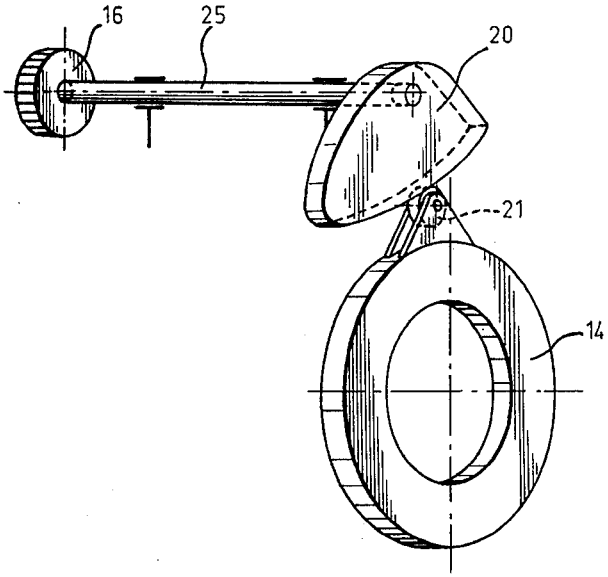
FIG. 4 diagrammatically represents another embodiment of the control.

FIG. 4 diagrammatically represents a control means using a cam. The pinion 16 drives a cam 20 against which a roller 21, mounted on rim 14, is applied. The profile of the cam 20 is determined point by point so as to achieve the relationship (3) between angles $\alpha_1$ and $\alpha_2$, taking into account the dimensions of the cranks 10 and 13, of the small rods 12 and 15, and of the rims 11 and 14.

Figure 5:
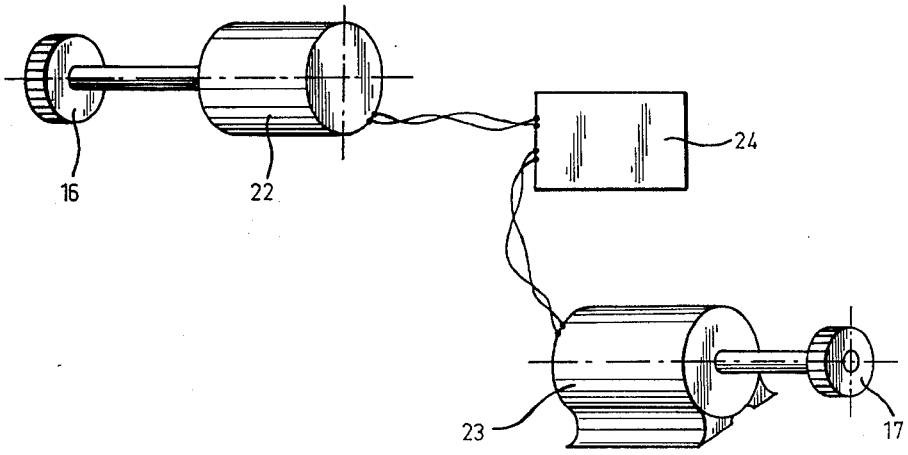
FIG. 5 diagrammatically represents an electrical construction for the control.

Another embodiment of this control is diagrammatically represented in FIG. 5. It consists of linking the pinions 16 and 17 respectively to an angular position pick-up 22 and to an electric motor 23 which is controlled in position by means of an electronic circuit 24 of known type capable of controlling the rotation of the motor 23 in terms of that of the pick-up 22 according to a law determined by relationship (3) on the one hand and the set pf cranks, small rods and rims on the other hand.

Other methods of constructing this control can, within the scope of this invention, be conceived. For example, the pick-up 22 and the electric motor 23 could be replaced by a hydraulic or pneumatic assembly which would produce the same results. Accordingly, the shaft 25 linking pinions 16 and 17 (FIG. 1) or the pinion 16 and the cam 20 (FIG. 4) can be in two parts separated by any servo-control system allowing multiplication of the effort supplied by blades 8 to exert better action on blades 5.

This invention is applicable to any type or turbine pump whenever a good output is desired for various regimes of functioning. This is especially the case with hydraulic transmissions, and more particularly those equipping a vehicle because variations in loade, in gradient and other lead to greatly varying values in flow and pressure.

What I claim is:

1. A turbine pump comprising a rotor (1) having rotor blades (2), an inlet pipe (3), an outlet casing (4), inlet guide blades (5) disposed between said inlet pipe and said rotor, outlet guide blades (8) disposed between said rotor and said outlet casing, said inlet guide blades and said outlet guide blades being pivotable, and automatic control means to control the pivoting of said inlet guide blades, wherein said automatic control means is in turn controlled by the pivoting of the outlet guide blades and wherein the angle of the pivoting of said outlet guide blades is controlled by the fluid pressure acting on said outlet guide blades.

2. Turbine pump according to claim 1, said control means maintaining the relationship wherein the cotangent of the rotation angle $\alpha_1$ of the inlet blades (5) is a linear function of the cotangent of the rotation angle $\alpha_2$ of the outlet blades (8).

3. Turbine pump according to claim 1 or claim 2, the outlet blades (8) being linked by connecting rod-crank assemblies (12-10) to a first rim (11), the inlet blades (5) to a second rim (14), and said control means rotates said second rim (14) from the rotation of said first rim (11).

4. Turbine pump according to claim 3, said control means including a shaft (25), two pinions (16) and (17) mounted on said shaft and respectively meshing with said first rim (11) and said second rim (14).

5. Turbine pump according to claim 3, said control means including a cam (20) linking said first rim (11) and said second rim (4); and the profile of which is specially adapted to cause said inlet guide blades to pivot to an angle corresponding to maximum output for the turbine pump.

6. Turbine pump according to claim 3, the said control means including a motor (23) driving said second rim (14) and a logic circuit (24) controlling said motor connected to an angular position pick-up (22) linked to said first rim (11).

7. Turbine pump according to claim 1, or claim 2 or claim 4 or claim 5 or claim 6, each inlet blade (5) pivoting around a spindle (6) parallel to the axis of rotation of rotor (1) and located approximately in its middle plane in such a way that the pressures exercised by the fluids become substantially balanced on either side of spindle (6).

8. Turbine pump according to claim 7 said intake pipe (3) comprising a central core (7) having an internal profile following trajectory edges of the inlet blades (5).

* * * * *